US007967661B2

(12) United States Patent
Taylor et al.

(10) Patent No.: US 7,967,661 B2
(45) Date of Patent: Jun. 28, 2011

(54) SYSTEMS AND PADS FOR PLANARIZING MICROELECTRONIC WORKPIECES AND ASSOCIATED METHODS OF USE AND MANUFACTURE

(75) Inventors: Theodore M. Taylor, Boise, ID (US); Andrew Carswell, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 386 days.

(21) Appl. No.: 12/142,515

(22) Filed: Jun. 19, 2008

(65) Prior Publication Data

US 2009/0318061 A1 Dec. 24, 2009

(51) Int. Cl.
*B24B 41/00* (2006.01)

(52) U.S. Cl. ..... 451/6; 451/8; 451/41; 451/287

(58) Field of Classification Search ..... 451/6, 8, 451/41, 285–290
See application file for complete search history.

(56) References Cited

U.S. PATENT DOCUMENTS

| | | | | |
|---|---|---|---|---|
| 5,337,015 | A | 8/1994 | Lustig et al. | |
| 5,433,651 | A | 7/1995 | Lustig et al. | |
| 5,605,760 | A | 2/1997 | Roberts | |
| 6,068,539 | A | 5/2000 | Bajaj et al. | |
| 6,108,092 | A | 8/2000 | Sandhu | |
| 6,399,501 | B2 | 6/2002 | Birang et al. | |
| 6,447,369 | B1 | 9/2002 | Moore | |
| 6,488,568 | B1 | 12/2002 | Treur et al. | |
| 6,565,416 | B2 | 5/2003 | Dunton et al. | |
| 6,716,085 | B2 | 4/2004 | Wiswesser et al. | |
| 6,749,483 | B2 | 6/2004 | Simon | |
| 6,832,949 | B2 | 12/2004 | Konno et al. | |
| 6,855,034 | B2 | 2/2005 | Hasegawa | |
| 6,922,253 | B2 | 7/2005 | Moore | |
| 6,929,530 | B1 | 8/2005 | Elledge | |
| 7,121,921 | B2 | 10/2006 | Taylor | |
| 7,198,544 | B2 | 4/2007 | Wiswesser | |
| 7,273,407 | B2 * | 9/2007 | Saikin et al. | 451/6 |
| 7,323,415 | B2 | 1/2008 | Shiho et al. | |
| 2001/0009838 | A1 | 7/2001 | Dunton et al. | |
| 2002/0173231 | A1 * | 11/2002 | Hasegawa | 451/6 |
| 2002/0191197 | A1 * | 12/2002 | Bibby et al. | 356/630 |

(Continued)

FOREIGN PATENT DOCUMENTS

JP 2004228101 A 8/2004

(Continued)

OTHER PUBLICATIONS

Allen, R. et al. "In-situ CMP Copper Endpoint Control System," 2001 IEEE International Semiconductor Manufacturing Symposium, Oct. 8-10, 2001, pp. 391-394.

(Continued)

*Primary Examiner* — Maurina Rachuba
(74) *Attorney, Agent, or Firm* — Perkins Coie LLP

(57) ABSTRACT

Planarizing systems and methods of planarizing microelectronic workpieces using mechanical and/or chemical-mechanical planarization are disclosed herein. In one embodiment, a planarizing system includes a platen having a support surface carrying a planarizing pad. The planarizing pad includes an optically transmissive window extending through the planarizing pad that forms a continuous segment of the planarizing pad. The system also includes a workpiece carrier configured to move the workpiece relative to the planarizing pad and an optical monitor positioned proximate to the platen. The optical monitor emits light through the window and detects reflected light from the workpiece through the window.

24 Claims, 6 Drawing Sheets

U.S. PATENT DOCUMENTS

| | | | | |
|---|---|---|---|---|
| 2003/0064663 | A1* | 4/2003 | Muilenburg et al. | 451/6 |
| 2005/0090105 | A1* | 4/2005 | Elledge | 438/689 |
| 2005/0173259 | A1 | 8/2005 | Mavliev et al. | |
| 2006/0037699 | A1 | 2/2006 | Nakamori et al. | |
| 2006/0276109 | A1 | 12/2006 | Roy et al. | |
| 2007/0105247 | A1 | 5/2007 | Mauersberger et al. | |
| 2007/0197147 | A1 | 8/2007 | Rondum et al. | |
| 2007/0212979 | A1 | 9/2007 | Preston | |
| 2007/0275637 | A1* | 11/2007 | Elledge | 451/8 |
| 2008/0003923 | A1 | 1/2008 | Benvegnu et al. | |
| 2008/0064300 | A1 | 3/2008 | Swedek et al. | |
| 2008/0099443 | A1 | 5/2008 | Benvegnu et al. | |
| 2008/0102734 | A1 | 5/2008 | Benvegnu et al. | |
| 2009/0305610 | A1* | 12/2009 | Yilmaz et al. | 451/6 |

FOREIGN PATENT DOCUMENTS

| | | | |
|---|---|---|---|
| JP | 2007049163 | A | 2/2007 |
| WO | 0054935 | A1 | 9/2000 |
| WO | 2007024807 | A2 | 3/2007 |

OTHER PUBLICATIONS

Chan, D.A. et al. "Process Control and Monitoring with Laser Interferometry Based Endpoint Detection in Chemical Mechanical Planarization," 1998 IEEE/SEMI Semiconductor Manufacturing Conference and Workshop, Sep. 23-25, 1998, pp. 377-384.

Economikos, L. et al. "Integrated Electro-Chemical Mechanical Planarization (Ecmp) for Future Generation Device Technology," Proceedings of the IEEE 2004 International Interconnect Technology Conference, Jun. 7-9, 2004, pp. 233-235.

Fang, S.J. et al. "Control of Dielectric Chemical Mechanical Polishing (CMP) Using an Interferometry Based Endpoint Sensor," Proceedings of the IEEE 1998 International Interconnect Technology Conference, Jun. 1-3, 1998, pp. 76-78.

Jaiswal, R. et al. "In-Situ Predictive Endpoint for Dual Damascene Trench Etch Depth Control for Composite Dielectric Films," 2003 IEEE International Symposium on Semiconductor Manufacturing, Sep. 30-Oct. 2, 2003, pp. 370-373.

Suni, I.I. and Bing Du, "Cu Planarization for ULSI Processing by Electrochemical Methods: A Review," IEEE Transactions on Semiconductor Manufacturing, vol. 18, No. 3, pp. 341-349, Aug. 2005.

Wang, J.C. et al. "A High Productivity and Low Topography W CMP Process Enabled by a Dual Endpoint System and Novel Pad Conditioning," 2006 IEEE International Symposium on Semiconductor Manufacturing, Sep. 25-27, 2006, pp. 195-198.

* cited by examiner

SYSTEMS AND PADS FOR PLANARIZING MICROELECTRONIC WORKPIECES AND ASSOCIATED METHODS OF USE AND MANUFACTURE

TECHNICAL FIELD

The present disclosure is directed to mechanical and/or chemical mechanical planarization of microelectronic workpieces.

BACKGROUND

Mechanical and chemical-mechanical planarizing processes (collectively "CMP") remove material from the surface of workpieces. These workpieces can include wafers or other microelectronic substrates in the production of microelectronic devices and other products. One goal of CMP processing is to consistently and accurately produce a uniformly planar surface on the workpiece to enable precise fabrication of circuits and photo-patterns. During the construction of transistors, contacts, interconnects and other microelectronic features, many workpieces develop large "step heights" that create highly topographic surfaces. Such highly topographical surfaces can impair the accuracy of subsequent photolithographic procedures and other processes that are necessary for forming sub-micron features. For example, it is difficult to accurately focus photo patterns within tight tolerances on topographic surfaces because sub-micron photolithographic equipment generally has a very limited depth of field. Thus, CMP processes are often used to transform a topographical surface into a highly uniform, planar surface at various stages of manufacturing microelectronic devices on a substrate.

To create a planar surface on a workpiece, a CMP system typically includes a workpiece carrier that presses the workpiece against a rotating planarizing pad. A slurry, such as an abrasive slurry, is also typically used to facilitate the planarization and material removal from the surface of the workpiece. During the planarizing process, however, many different factors can affect the planarization or material removal rate. Such factors include, for example, variances in the distribution and size of abrasive particles in the slurry, topographical areas with different densities of features across the workpiece, the velocity of the relative movement between the workpiece and the planarizing pad, the pressure with which the workpiece is pressed against the planarizing pad, the condition of the planarizing pad, etc.

DETAILED DESCRIPTION

Various embodiments of planarizing systems and methods of using a planarizing pad to planarize, polish, or otherwise remove material from a surface of a microelectronic workpiece are described below. Certain details are set forth in the following description to provide a thorough understanding of various embodiments of the disclosure. Other details describing well-known structures and components often associated with CMP systems and processes are not set forth below, however, to avoid unnecessarily obscuring the description of the various embodiments of the disclosure. The term "surface" can encompass planar and nonplanar surfaces, either with or without patterned and nonpatterned features of a microelectronic workpiece. Such a workpiece can include one or more conductive and/or nonconductive layers (e.g., metallic, semiconductive, and/or dielectric materials) that are situated upon or within one another. These conductive and/or nonconductive layers can also contain a myriad of electrical elements, mechanical elements, and/or systems of such elements in the conductive and/or nonconductive layers (e.g., an integrated circuit, a memory, a processor, a microelectromechanical system (MEMS), etc.). Other embodiments of planarizing systems or methods of workpiece planarization in addition to or in lieu of the embodiments described in this section may have several additional features or may not include many of the features shown and described below with reference to FIGS. 1A-5.

Figure 1A:
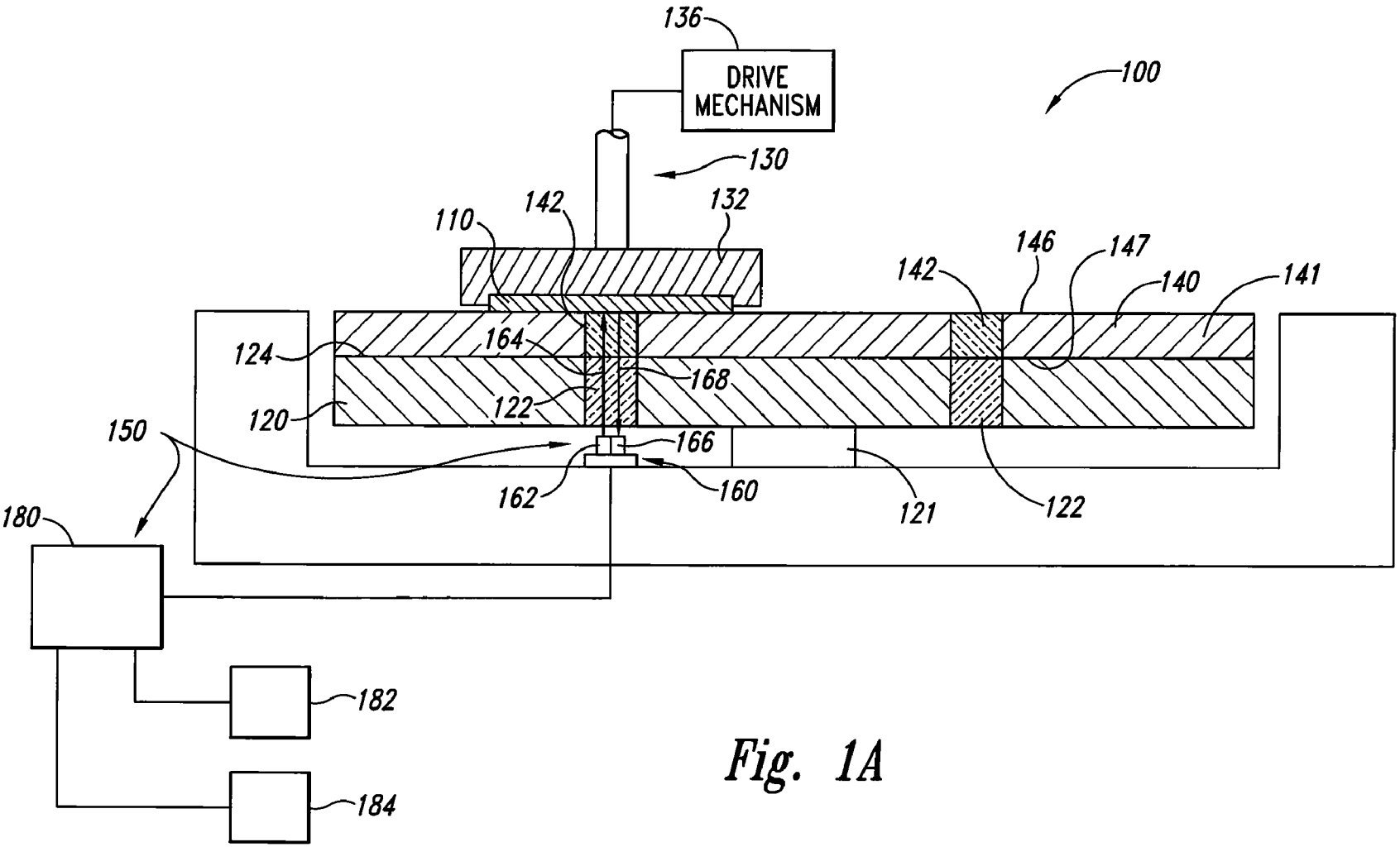
FIG. 1A is a cross-sectional side view of a planarizing system configured in accordance with an embodiment of the disclosure.

FIG. 1A is a cross-sectional view of a planarizing system 100 configured in accordance with an embodiment of the disclosure. Several features of the planarizing system 100 are shown schematically. In the illustrated embodiment, the planarizing system 100 includes a table or platen 120 operably coupled to a drive mechanism 121 that rotates the platen 120. The platen 120 includes an optically transmissive platen window 122 and a support surface 124. In this embodiment, the platen window 122 is an optically transmissive member having an annular or other suitable ring-like shape. The platen window 122, for example, can be a circular glass member positioned concentrically with respect to the axis of rotation of the platen 120. The planarizing system 100 also includes a planarizing pad 140 carried by the support surface 124 of the platen 120. The planarizing pad 140 includes a planarizing medium or body 141. The body 141 can be made from polymeric materials, including, for example, polyurethane, nylon, etc., or other materials suitable for planarizing processes. The body 141 can also be an abrasive or non-abrasive medium having a planarizing surface 146 configured to planarize a semiconductor workpiece 110. For example, the body 141 can have a resin binder with a plurality of abrasive particles fixedly attached to the resin binder.

The planarizing pad 140 also includes an optically transmissive pad window 142 extending therethrough. In the illustrated embodiment and as described in detail below, the pad window 142 has an annular or other suitable ring-like shape that corresponds, at least in part, to the shape of the platen window 122. The pad 140 is carried on the platen 120 such that the pad window 142 is at least generally aligned with the platen window 122. In one embodiment, the pad window 142 can be an insert embedded in the planarizing medium 141 and/or adhered to the planarizing medium 141 with an adhesive. The insert can extend completely through the body of the planarizing medium 141 from the planarizing surface 146 to a backside surface 147. Suitable materials for the optically transmissive window include polyester (e.g., optically transmissive Mylar®), polycarbonate (e.g., Lexan®), fluoropolymers (e.g., Teflon®), glass, and/or other optically transmissive materials that are suitable for contacting a surface of a workpiece 110 during a planarizing process. In other embodiments, the pad window 142 can be integrally formed in the pad 140. For example, the pad 140 can be formed from a polymeric material and the pad window 142 can be a segment of the pad 140 that is cured at a different rate than the remainder of the pad 140 to achieve the optically transmissive properties of the pad window 142. Moreover, in certain embodiments, the planarizing pad 140 can include more than one pad window 142. For example, in one embodiment the planarizing pad 140 can include several spaced-apart pad windows 142 arranged at least generally concentrically with respect to the rotational axis of the planarizing pad 140. In embodiments including multiple pad windows 142, the platen 120 can also include multiple platen windows 122 generally aligned with the corresponding pad windows 142.

The planarizing system 100 also includes a carrier assembly 130 having a head or workpiece holder 132 operably coupled to a drive mechanism 136. The workpiece holder 132 holds the microelectronic workpiece 110 and can press and/or move the workpiece 110 against the planarizing surface 146 of the planarizing pad 140 during processing.

The planarizing system 100 further includes a control system 150 having an optical monitor 160 and a computer 180. In the illustrated embodiment, the optical monitor 160 includes a light source 162 (e.g., a laser, LED, broad spectrum, etc.) that generates source light 164 (represented by upward pointing arrow), and a sensor 166 having a photo cell to receive reflected light 168 (represented by downward pointing arrow) from the workpiece 110. The light source 162 is configured to direct the source light 164 through the platen window 122 and the pad window 142 so that the source light 164 impinges a front surface of the microelectronic workpiece 110 during a planarizing cycle. In one embodiment, the light source 162 generates a continuous exposure of source light 164 and the sensor 166 is configured to continuously receive the reflected light 168 from the front surface of the workpiece 110. In other embodiments, however, the light source 162 can generate intermittent source light 164 (e.g., strobe, pulse, or flashing type of light, etc.) toward the workpiece 110. In the illustrated embodiment, the optical monitor 160 is retained in a generally stationary position beneath the platen 120 and planarizing pad 140. Other embodiments, however, can include a movable optical monitor or multiple optical monitors. Moreover, in certain embodiments, the optical monitor 160 can have one or more light sources that emit radiation at discrete bandwidths in the infrared spectrum, ultraviolet spectrum, visible spectrum, and/or other radiation spectrums. The terms "optical" and "light," therefore, are not limited to the visual spectrum for the purposes of the present disclosure.

The computer 180 is coupled to the optical monitor 160 to activate the light source 162 and/or to receive a signal from the sensor 166 corresponding to characteristics (e.g., intensity, color, etc.) of the reflected light 168. The computer 180 can include a database 182 containing a plurality of sets of reference characteristics corresponding to the status of a layer of material on the workpiece 110. The computer 180 can also contain a computer-readable program 184 that causes the computer 180 to control parameters of the planarizing system 100 according to feedback from the sensor 166. For example, when the measured characteristics of the reflected light 168 correspond to a selected set of the reference characteristics in the database 182, the computer-readable program can cause the planarizing system 100 to increase or decrease the planarizing speed, pressure, time, etc.

Figure 1B:
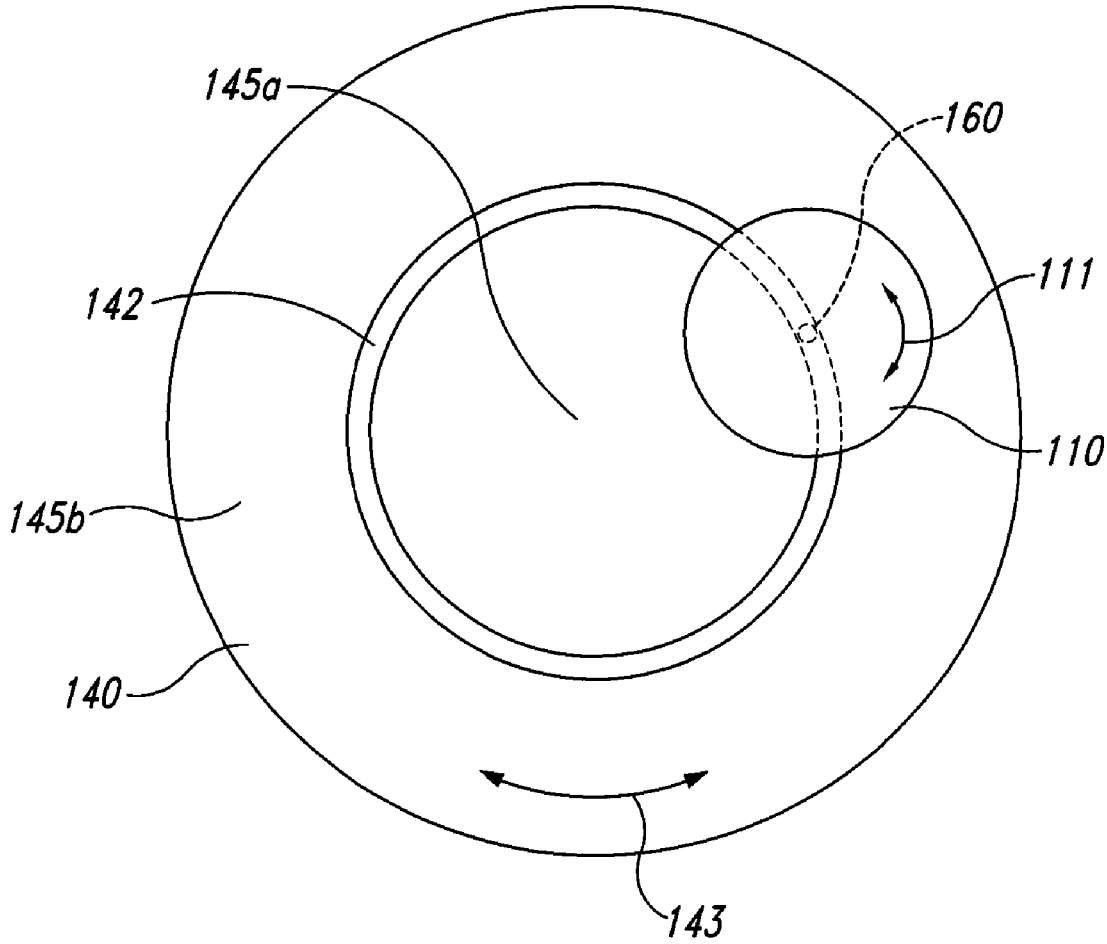
FIG. 1B is a plan view of a planarizing pad and a microelectronic workpiece employed in the planarizing system of FIG. 1A.

FIG. 1B is a plan view illustrating an embodiment of the planarizing pad 140 during a planarizing cycle of the microelectronic workpiece 110. In the illustrated embodiment, the pad window 142 is a circular window positioned at least generally concentrically with respect to the rotational axis of the planarizing pad 140. The pad window 142, for example, can be a continuous circle. Although a circle is described, other shapes, such as an ellipse, are contemplated. In this manner, the uninterrupted pad window 142 separates an inner portion 145*a* of the planarizing pad 140 from an outer periphery portion 145*b*. The optical monitor 160 is positioned beneath a footprint of the workpiece 110 and is aligned with the pad window 140. In this position, the optical monitor 160 can emit light toward the workpiece 110 and sense light reflected from the workpiece 110 through the pad window 160.

Referring to FIGS. 1A and 1B together, in operation the planarizing system 100 creates relative motion between the workpiece 110 and the planarizing pad 140 by rotating the planarizing pad 140 as indicated by a first double-headed arrow 143, and/or rotating the workpiece 110 as indicated by a second double-headed arrow 111. This relative motion combined with a down force on the workpiece 110 removes material from the workpiece 110 to planarize or polish the front surface of the workpiece 110. As the planarizing pad 140 moves, the optical monitor 160 continuously monitors the surface condition of the workpiece 110 during at least a portion of the planarizing process. More specifically, because the pad window 142 is a continuous ring-like structure, it exposes the workpiece 110 to the optical monitor 160 without interruption. As a result, the sensor 166 can continuously detect characteristics of the reflected light 168 through the annular shaped pad window 142 and platen window 122 during at least one complete rotation of the planarizing pad 140.

In this manner, the sensor 166 can continuously measure characteristics of the reflected light 168, which can vary during the planarizing cycle as the face of the workpiece 110 changes throughout the planarizing cycle. A typical workpiece 110, for example, includes several layers of materials (e.g., silicon dioxide, silicon nitride, aluminum, etc.), and each material type can have distinct reflectance properties. For example, the color properties of a surface on a workpiece are a function of the individual colors of the layers of materials on the workpiece, the transparency and refraction properties of the layers, the interfaces between the layers, the thickness of the layers, etc. As such, when the surface of the workpiece 110 changes, the characteristics of the reflected light 168 can change accordingly. As the sensor 166 continuously detects the characteristics of the reflected light 168, the computer 180 receives the corresponding data regarding the characteristics of the workpiece. The computer 180 is therefore able to continuously evaluate the surface condition of the workpiece 110 to adjust parameters of the planarizing process and/or end the planarizing process in response to the uninterrupted detection of the reflected light 168.

The continuous detection of the surface characteristics of the workpiece 110 during at least one complete rotational cycle of the planarizing pad 160 differs from the detection of a conventional CMP system, because the optical monitoring of conventional planarizing processes is limited by the platen rotation speed. In a conventional CMP system, for example, a light source is typically carried by the platen and rotates with the platen beneath a workpiece. In this type of system, a conventional planarizing pad includes a small window in the pad that is aligned with the light source that does not circumscribe a full ring within the pad. As a result, the small window exposes the workpiece to the light source during only an arc of a revolution of the platen. In this manner, the sampling frequency of the light source is limited by the rotational speed of the platen. In another type of conventional CMP system, the light source may remain stationary beneath the planarizing pad and the workpiece, and the planarizing pad includes one or more separate windows arranged in a line or a portion of an arc to expose the workpiece to the light source. Although multiple windows may increase the number of measurements, the rotational speed of the platen still limits the sampling frequency.

In contrast to conventional CMP systems, embodiments of the planarizing system 100 with the continuous ring-like window 142 provide continual access for the optical monitor 160 to the workpiece 110 throughout a complete revolution of the platen 120. Uninterrupted data collection can provide for more precise adjustments to processing parameters (e.g., zone pressures, polishing speed and time, pad condition, etc.) resulting in better control of the workpiece polishing. The continuous monitoring also provides consistent planarization results because real-time adjustments can be made at anytime throughout the rotational position of the platen 120. The continuous data collection can also accurately endpoint a planarizing cycle without significantly increasing the processing time for each workpiece. For example, it is generally desirable to maximize the throughput of CMP processing by producing a planar surface on a workpiece as quickly as possible. The throughput of CMP processing is a function, at least in part, of the polishing rate of the workpiece and the ability to accurately stop CMP processing at a desired endpoint. The ability to continuously monitor the surface condition of the workpiece throughout the entire revolution of the platen 120 can therefore enhance the accuracy of determining the endpoint of a planarizing cycle.

Figure 2A:
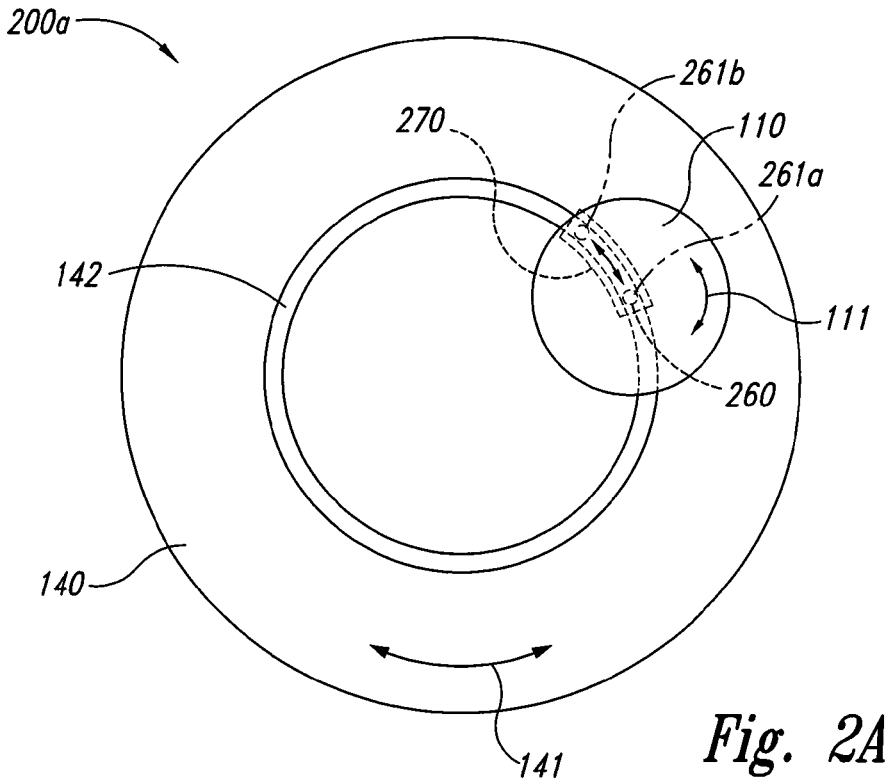
FIGS. 2A and 2B are plan views of certain components of planarizing systems configured in accordance with further embodiments of the disclosure.

FIG. 2A is a plan view of several components of a planarizing system 200*a* configured in accordance with another embodiment of the disclosure. The components of the planarizing system 200*a* illustrated in FIG. 2A are generally similar in structure and function to those of the planarizing system 100 described above with reference to FIGS. 1A and 1B. For example, the planarizing system 200*a* includes the planarizing pad 140 with the optically transmissive pad window 142 shaped in a continuous circle, or other useful shape. In the illustrated embodiment, however, the planarizing system 200*a* includes an optical monitor 260 that can move or oscillate between different monitoring positions 261 (identified individually as a first position 261*a* and a second position 261*b*). More specifically, the optical monitor 260 can be mounted to the tool below the platen and configured to move along a track 270 (shown in broken lines) or path generally aligned with the pad window 142. According to one example of the illustrated embodiment, the track 270 can have a radius of curvature generally matching that of the pad window 142. Although not illustrated in FIG. 2A, the optical monitor 260 can include several of the optical monitoring components (e.g., a light source, sensor, etc.) described above with reference to the optical monitor 160 of FIGS. 1A and 1B.

In the first position 261*a*, the optical monitor 260 is positioned generally beneath the center portion of the workpiece 110, and in the second position 261*b* the optical monitor 260 is positioned beneath a peripheral edge portion of the workpiece 110. As the optical monitor 260 moves between positions 261, it can continuously assess the surface characteristics across an entire radial segment of the surface of the workpiece 110. For example, when the workpiece 110 is rotating in the direction indicated by the arrow 111 and the optical monitor 160 moves between the first position 161*a* and the second position 161*b*, the optical monitor 160 can assess all of the surface characteristics of the workpiece 110 ranging from the center portion to the outer periphery portion of the workpiece 110.

Figure 2B:
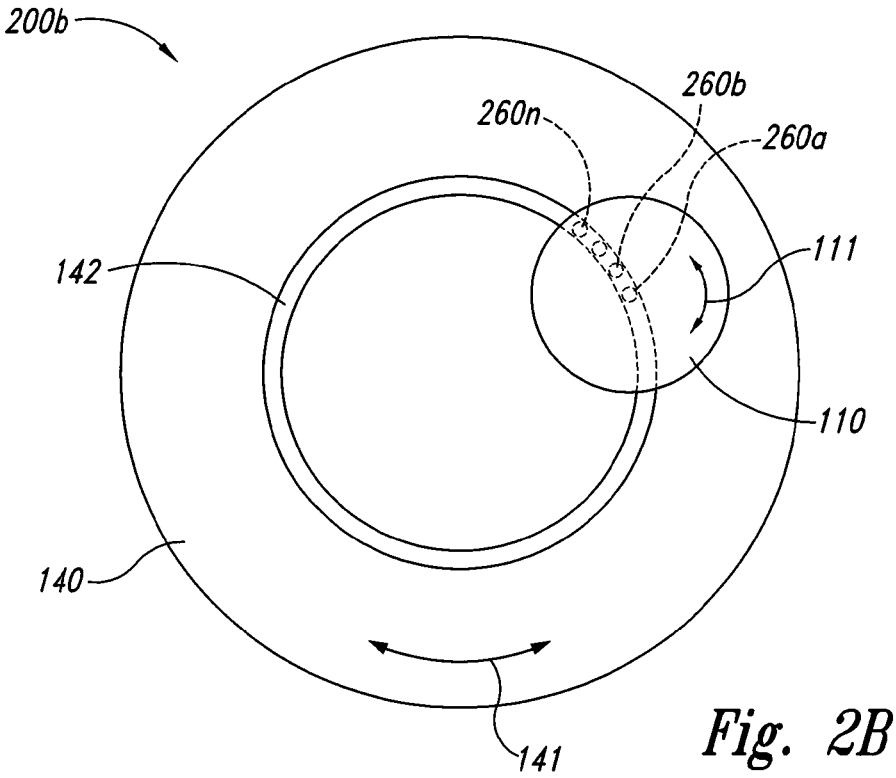

FIG. 2B is a plan view of several components of a planarizing system 200*b* configured in accordance with another embodiment of the disclosure. The planarizing system 200*b* is generally similar to the planarizing system 200*a* described above with reference to FIG. 2A. In the illustrated embodiment, however, the planarizing system 200*b* includes an array of multiple optical monitors 260 (identified individually as a first optical monitor 260*a* through $n^{th}$ optical monitor 260*n*). The optical monitors 260 are positioned within a footprint of the workpiece 110 extending from a center portion to a peripheral edge portion of the workpiece 110. In this manner, the optical monitors 260 can monitor the surface characteristics at several different areas of the rotating workpiece 110. The optical monitors 260 can also be configured to simultaneously or sequentially monitor the planarization of the corresponding portions of the workpiece 110.

Figure 3:
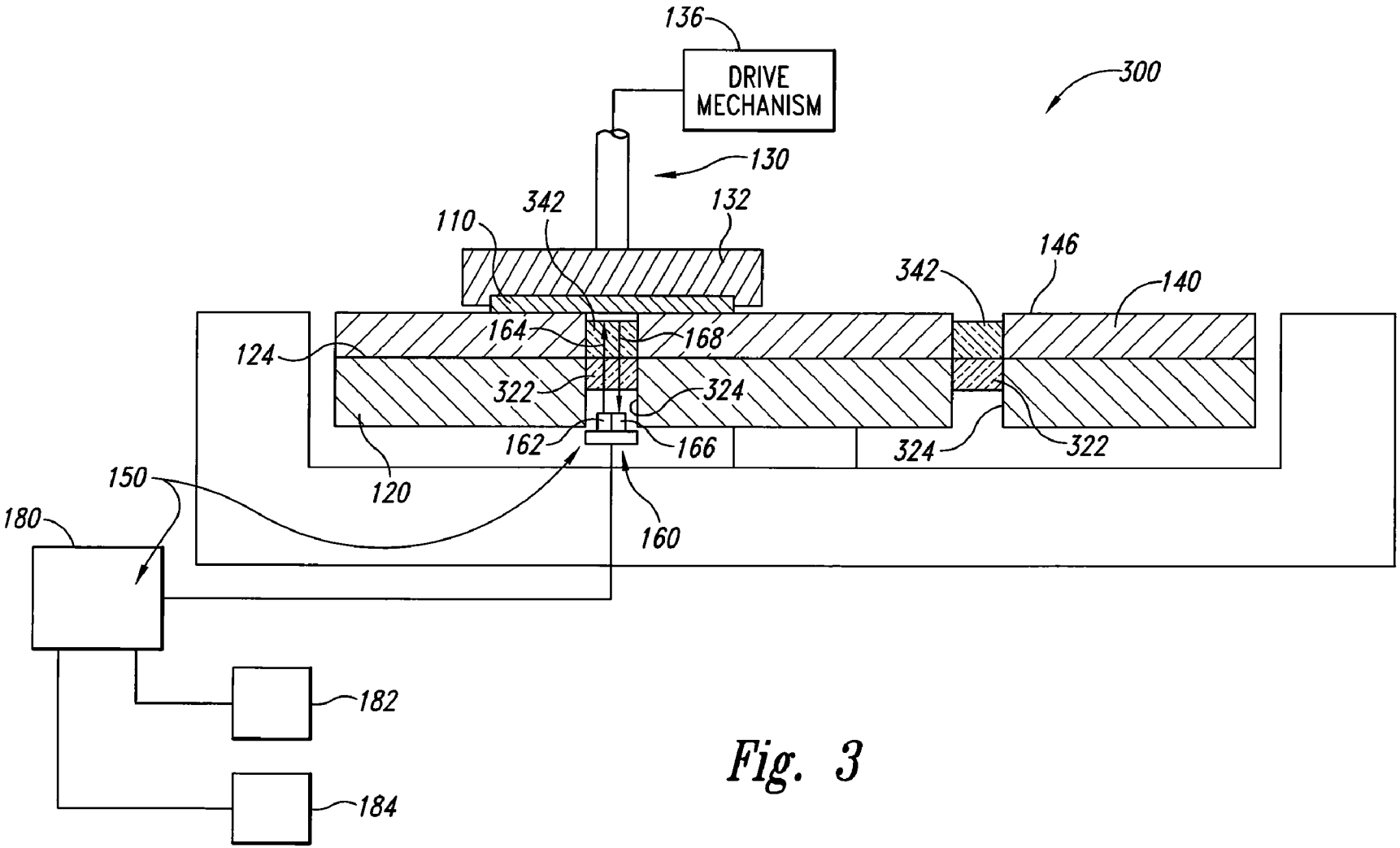
FIG. 3 is a cross-sectional side view of a planarizing system configured in accordance with another embodiment of the disclosure.

FIG. 3 is a side cross-sectional view of a planarizing system 300 configured in accordance with another embodiment of the disclosure. The planarizing system 300 is generally similar in structure and function to the planarizing systems described above with reference to FIGS. 1A-2B. For example, the planarizing system 300 includes the planarizing pad 140 carried by the platen 120. The planarizing system 300 also includes a platen window 322 and a pad window 342, each of which can be circular (or other useful shapes) and concentrically aligned with the platen 120 and planarizing pad 140, respectively, to provide continuous exposure to the workpiece 110. In the illustrated embodiment, however, the platen window 322 does not extend through the entire thickness of the platen 120. More specifically, the platen window 322 is positioned in a cavity 324 in the platen 120 and the platen widow 322 does not fill the entire cavity 324. According to another example of the illustrated embodiment, the pad window 342 is slightly recessed from the planarizing surface 146 of the planarizing pad 140. For example, in one embodiment the pad window 342 can be made from a material that is different than the planarizing pad 140 and embedded in the planarizing pad 140. A pad window 342 that is slightly recessed from the planarizing surface 146 can at least partially limit non-uniformities or discontinuities in the polishing due to the different materials of the pad window 342 and the planarizing surface 146.

In the operation of the embodiment illustrated in FIG. 3, the source light 164 and reflected light 168 travel through a reduced amount of window material, thereby experiencing less diffraction. More specifically, the platen window 322 only partially fills the cavity 324. As a result, the reflected light 168 does not travel through window material having the same thickness as the platen 120. Moreover, in certain embodiments, the optical sensor 160 can be positioned at least partially within the cavity 324 to decrease the distance between the workpiece 110 and the light source 162 and sensor 166. Another feature of the illustrated embodiment is that the recessed pad window 342 does not affect with the planarization of the workpiece 110.

Figure 4:
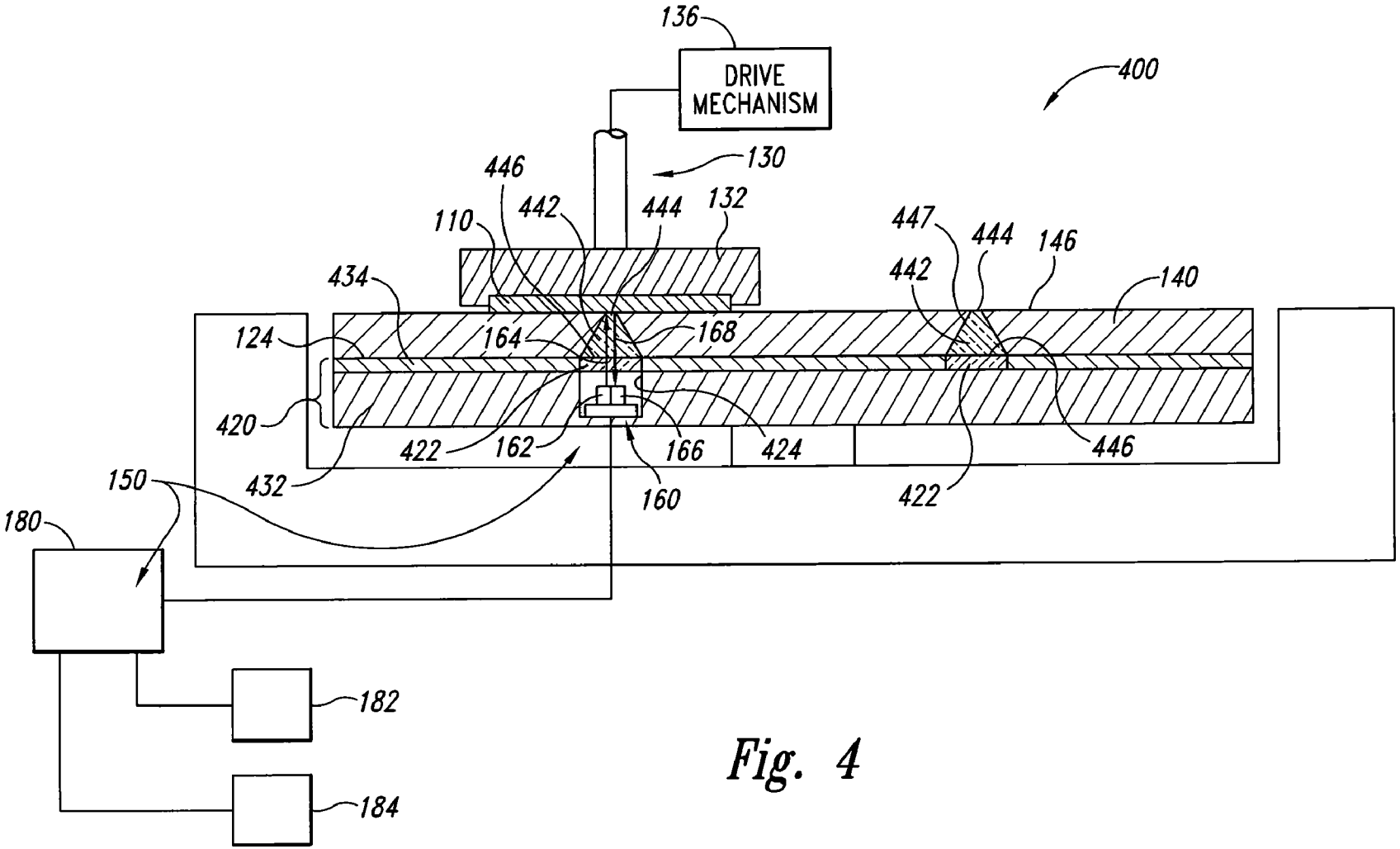
FIG. 4 is a cross-sectional side view of a planarizing system configured in accordance with yet another embodiment of the disclosure.

FIG. 4 is a side cross-sectional side view of a planarizing system 400 configured in accordance with another embodiment of the disclosure. The planarizing system 400 is generally similar in structure and function to the planarizing systems described above with reference to FIGS. 1A-3. For example, the planarizing system 400 includes the optical monitor 160 configured to continuously monitor the workpiece 110 as the planarizing pad 140 moves relative to the workpiece 110. In the illustrated embodiment, however, the planarizing system 400 includes a two-part platen 420 that carries and moves the planarizing pad 140 relative to the workpiece 110. More specifically, the platen 440 includes a generally stationary portion 432 and a rotating portion 434 that rotates with reference to the stationary portion 432. The optical monitor 160 is carried in a cavity 424 in the stationary portion 432. A platen window 422 is positioned above the optical monitor 160 and generally aligned with a pad window 442 in the planarizing pad 140.

According to another feature of the embodiment illustrated in FIG. 4, the pad window 442 has a generally triangular cross-sectional shape. More specifically, the pad window 442 includes a first surface 444 at the planarizing surface 146 of the planarizing pad 140, and a second surface 446 proximate to the support surface 124 of the platen 420, and an inclined side surface 447 between the first and second surfaces 444 and 446. In the illustrated embodiment, the second surface 446 is wider than the first surface 444 such that the window 442 has a frusto-conical shape. Providing a smaller first surface 444 of the pad window 442 provides a generally consistent planarizing surface 146 that is in contact with the workpiece 110, while still providing adequate space to transmit the source light 164 and the reflected light 168. For example, the first surface 444 of the pad window 442 provides a relatively small interruption in the surface 146 of the planarizing pad 140, and the expansion of the pad window 442 from the first surface 444 to the second surface 446 accommodates the reflected light 168 that may be refracted through the windows or otherwise reflected at an angle off of the workpiece 110. For example, as material is removed from the workpiece 110 to expose different layers thereof, the source light 164 may reflect off the changing layers of the workpiece 110 at different angles.

Figure 5:
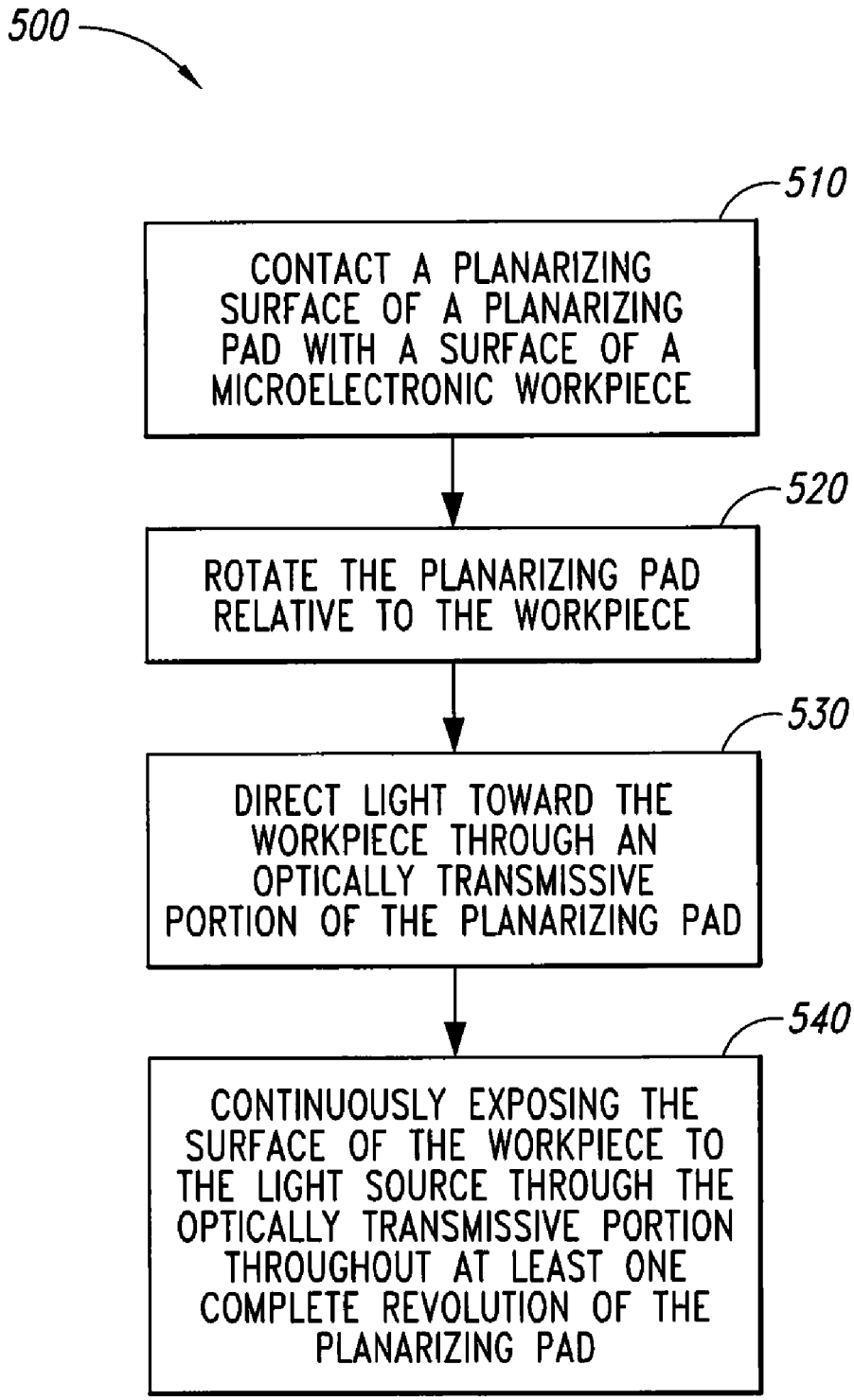
FIG. 5 is a flow diagram of a planarization process configured in accordance with an embodiment of the disclosure.

FIG. 5 is a flow diagram illustrating an example of a process 500 for planarizing a microelectronic workpiece. In this embodiment, the process 500 includes contacting a planarizing surface of a planarizing pad with a surface of a workpiece (block 510). The planarizing pad includes an optically transmissive portion, which can include a ring-shaped window that is concentrically aligned with a rotational axis of the planarizing pad. The process 500 also includes rotating the planarizing pad relative to the workpiece (block 520) and directing light toward the workpiece through the optically transmissive portion of the planarizing pad (block 530). In one embodiment, an optical monitor including a light source can be positioned proximate to the planarizing pad to direct the light toward the workpiece through the optically transmissive portion.

The process further includes continuously exposing the surface of the workpiece to the light source through the optically transmissive portion throughout at least one complete revolution of the planarizing pad (block 540). This stage of the method can further include directing the light toward the workpiece and detecting light reflected from the workpiece through the optically transmissive planarizing pad while the workpiece is held face-down in a chuck throughout at least one complete revolution of the platen. The optical monitor can also include a sensor to detect the reflected light. In one embodiment, the optical monitor can be located in a stationary position with reference to the planarizing pad to direct the light toward the workpiece and detect the reflected light from the workpiece. In other embodiments, however, the optical monitor can oscillate between positions generally aligned with the optically transmissive portion to monitor the entire surface of the workpiece. For example, the optical monitor can move between a first position corresponding to a center portion of the workpiece and a second position corresponding to a periphery edge portion of the workpiece. In still further embodiments, multiple optical sensors can be used to continuously monitor the entire surface of the workpiece. The method can further include controlling one or more processing parameters (e.g., processing time, pressure, rotational speed, etc.) in response to the continuously detected reflected light.

The process illustrated in FIG. 5 can provide consistent and accurate planarization results because the optical monitor can evaluate the surface condition of the workpiece without interruption. This is possible because the optically transmissive portion of the planarizing pad provides continuous exposure of the workpiece to the optical monitor throughout the complete revolution of the platen.

From the foregoing, it will be appreciated that specific embodiments of the disclosure have been described herein for purposes of illustration, but well-known structures and functions have not been shown or described in detail to avoid unnecessarily obscuring the description of the embodiments of the disclosure. Where the context permits, singular or plural terms may also include the plural or singular term, respectively. Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the term "comprising" is inclusive and is used throughout to mean including at least the recited feature(s) such that any greater number of the same feature and/or additional types of other features are not precluded. It will also be appreciated that specific embodiments of the disclosure have been described herein for purposes of illustration, but that various modifications may be made without deviating from the inventions. For example, many of the elements of one embodiment can be combined with other embodiments in addition to, or in lieu of, the elements of the other embodiments. Furthermore, although the illustrated embodiments generally describe CMP processing in the context of rotationally planarizing the surface of a microelectronic workpiece, other non-illustrated embodiments can employ CMP processing for other purposes such as for polishing. Accordingly, the disclosure is not limited except as by the appended claims.

We claim:

1. A system for planarizing a microelectronic workpiece, the system comprising:

a platen having a support surface;

a planarizing pad carried by the support surface, the planarizing pad having a planarizing medium and an optically transmissive window positioned within the planarizing medium, wherein the window comprises a continuous ring-like element circumscribing a 360° arc;

a workpiece carrier configured to move the workpiece relative to the planarizing pad; and an optical monitor positioned proximate to the platen, wherein the optical monitor is independent of the platen and emits light through the window and detects reflected light from the workpiece through the window, and wherein the optical monitor is movable along a path generally matching a radius of curvature of the window.

2. The system of claim 1 wherein:

the workpiece carrier holds the workpiece face-down with respect to the planarizing pad;

the window forms an integral portion of the planarizing pad and is positioned concentrically relative to a rotational axis of the platen within the planarizing pad;

the window is a first window and the platen includes a second window generally aligned with the first window; and the platen is configured to rotate the planarizing pad, and wherein the optical monitor includes at least one sensor that detects reflected light during at least one complete rotation of the planarizing pad through the first and second windows.

3. The system of claim 1 wherein the window is positioned concentrically relative to a rotational axis of the platen within the planarizing pad.

4. The system of claim 1 wherein the platen is configured to rotate the planarizing pad, and wherein the optical monitor includes at least one sensor that continuously detects reflected light during at least one complete rotation of the planarizing pad.

5. The system of claim 1 wherein the window is a first window and wherein the platen includes a second window generally aligned with the first window, and wherein the optical monitor emits light through the second window and detects reflected light through the second window.

6. The system of claim 5 wherein the first and second windows are made from the same material.

7. The system of claim 1 wherein the window is embedded in the planarizing pad.

8. The system of claim 1 wherein the window forms an integral portion of the planarizing pad.

9. The system of claim 1 wherein the optical monitor is located in a generally stationary position with reference to the planarizing pad and the workpiece during a planarization cycle.

10. The system of claim 1 wherein the optical monitor is movable along the path from a first position to a second position.

11. The system of claim 10 wherein in the first position the optical monitor is at least generally aligned with a center portion of the workpiece and in the second position the optical monitor is at least generally aligned with a periphery edge portion of the workpiece.

12. The system of claim 1 wherein the optical monitor is a first optical monitor, and wherein the system further comprises a second optical monitor spaced apart from the first optical monitor, the first and second optical monitors being positioned within a footprint of the workpiece.

13. The system of claim 1 wherein the workpiece carrier holds the workpiece in a face-down position with respect to the planarizing pad.

14. A system for planarizing a microelectronic workpiece with a pad, the system comprising:

a platen having a platen surface configured to carry the pad;

a workpiece carrier configured to move the microelectronic workpiece relative to the pad;

an optical monitor positioned proximate to the pad, wherein the optical monitor is movable along a curved path within a curved track between a first monitoring position and a second monitoring position, and wherein the pad comprises:

a body having a planarizing surface spaced apart from a support surface, wherein the planarizing surface is configured to remove material from the microelectronic workpiece and the support surface is configured to be carried by the platen surface; and a window in the body and having a generally ring-like shape, wherein the window is positioned concentrically in the body with respect to a rotational axis of the body, and wherein the window is transmissive to light and is configured to transmit the light from the support surface to the planarizing surface throughout an uninterrupted band extending completely around an inner portion of the body; and wherein the curved track has a curvature generally matching that of the window.

15. The system of claim 14 wherein the body further includes an outer portion, and wherein the window radially separates the inner portion from the outer portion of the body.

16. The system of claim 14 wherein the window is formed from the same material as the body.

17. The system of claim 14 wherein the window is formed from a different material than that of the body, and wherein the window is embedded in the body.

18. The system of claim 14 wherein the window has a window surface that is generally coplanar with the planarizing surface of the body.

19. The system of claim 14 wherein the window has a first width at the planarizing surface of the body and a second width at the support surface of the body, the second width being greater than the first width.

20. A method of planarizing a microelectronic workpiece, the method comprising:

contacting a planarizing surface of a planarizing pad with a surface of the workpiece, wherein the planarizing pad comprises an optically transmissive portion extending therethrough, the optically transmissive portion comprising a continuous ring-like element positioned concentrically in the planarizing pad;

rotating the planarizing pad relative to the workpiece;

directing light from an optical monitor toward the workpiece through the optically transmissive portion of the planarizing pad;

moving the optical monitor along a curved path from a first position to a second position during the rotation of the planarizing pad, the curved path having a radius of curvature generally matching that of the optically transmissive portion of the workpiece, wherein the first position is at least generally aligned with a center portion of the workpiece and the second position is at least generally aligned with a periphery portion of the workpiece; and continuously exposing the surface of the workpiece to the optical monitor through the optically transmissive portion throughout at least one complete revolution of the planarizing pad.

21. The method of claim 20, further comprising controlling a parameter of the planarizing of the workpiece in response to the continuously detected reflected light.

22. The method of claim 20 wherein directing light from a light source toward the workpiece includes directing light from the optical monitor while the optical monitor is stationary.

23. The method of claim 20, further comprising continuously detecting reflected light from the surface of the workpiece through the optically transmissive portion throughout at least one complete revolution of the planarizing pad.

24. The method of claim 20, further comprising detecting reflected light from the surface of the workpiece while moving the optical monitor from the first position to the second position.

* * * * *